United States Patent [19]

Lefranc

[11] Patent Number: 4,726,291

[45] Date of Patent: Feb. 23, 1988

[54] PROXIMITY FUSE FOR AN ARTILLERY PROJECTILE OF THE TYPE HAVING REDUCED AERODYNAMIC RESISTANCE OF THE BASE

[75] Inventor: André R. J. Lefranc, Voisins le Bretonneux, France

[73] Assignee: U.S. Philips Corporation, New York, N.Y.

[21] Appl. No.: 868,237

[22] Filed: May 28, 1986

[30] Foreign Application Priority Data

May 31, 1985 [FR] France ..... 85 08224

[51] Int. Cl.[4] ..... F42C 13/04

[52] U.S. Cl. ..... 102/214

[58] Field of Search ..... 102/214; 342/68

[56] References Cited

U.S. PATENT DOCUMENTS

| | | | |
|---|---|---|---|
| 3,802,343 | 4/1974 | Dahl | 102/214 |
| 3,906,493 | 9/1975 | Adrian et al. | 102/214 |
| 3,934,510 | 1/1976 | Dahl | 102/214 |
| 4,333,079 | 6/1982 | Dick et al. | 102/214 |
| 4,354,192 | 10/1982 | Kohler | 102/214 |

FOREIGN PATENT DOCUMENTS

| | | | |
|---|---|---|---|
| 1578513 | 5/1984 | Fed. Rep. of Germany | 102/214 |
| 2175810 | 10/1973 | France . | |
| 2223658 | 10/1974 | France . | |

*Primary Examiner*—Charles T. Jordan

*Attorney, Agent, or Firm*—Thomas A. Briody; Jack Oisher; William J. Streeter

[57] ABSTRACT

A proximity fuse for an artillery projectile of the type having reduced aerodynamic resistance of the base. The fuse comprises a radar arrangement (1,2,3,4) which supplies a beat signal ($S_e$) to a first chain for activating the trigger device (9) at the end of a time $t_1$ after $S_e$ has exceeded a given threshold. The fuse also comprises a supplementary chain for counteracting the effect of air resistance, which presents characteristics of cut off (32), of amplification (33) and of exceeding a threshold (35,36) comparable with those of the first chain, of which the output signal is transmitted to inhibition means (47,48,49,41,39 and 44, 38 and 43) and which comprises first and second delaying means (34).

5 Claims, 5 Drawing Figures

PROXIMITY FUSE FOR AN ARTILLERY PROJECTILE OF THE TYPE HAVING REDUCED AERODYNAMIC RESISTANCE OF THE BASE

BACKGROUND OF THE INVENTION

1. Field of the Invention

The invention relates to a proximity fuse for an artillery projectile, particularly projectiles of the type having reduced aerodynamic resistance of the base; comprising a radar arrangement for supplying at the output of a mixer a beat difference signal between a transmitted wave and a reflected wave to at least one first processing chain for activating the trigger device of the ignition circuit of said fuse at the end of a variable time $\tau_1$ of the order of a tenth second after the said amplified and filtered beat signal has exceeded a given number of times a given threshold.

2. Description of the Related Art

In order to enlarge the range of artillery shells a reduction of the air resistance of the base (RDTC, short for Réduction De la Trainée de Culot) is brought about, which resistance occurs during flight at the base of the shell, especially at the beginning of the trajectory. This reduction of resistance can be obtained by the emission of a gas jet at the base (designated as "base bleed"), of which the principle is explained below. The invention is applicable to a proximity fuse for this type of artillery projectile.

The proximity fuses comprise an electronic circuit sensitive to signals lying in predetermined frequency bands. This circuit responds either to signals transmitted from the allotted target or to reflected signals initially transmitted from the fired projectile, such as especially Doppler signals, the latter case being more particularly envisaged by the invention, which relates to shells, whose privileged target is the ground.

The major technical problem which arises for proximity fuses of this type is the risk of being influenced by parasitic signals, which can produce a premature ignition generally far from the target. In order to suppress these parasitic signals, a known means consists in that a first processing chain is adjoined by a second chain, whose main function is to inhibit the chain in the presence of parasitic signals, as described, for example, in French Pat. No. 2,175,810 and its Addition Pat. No. 2,223,658.

The parasitic signals which justify the presence of the second chain may be due to particular atmospheric conditions or to arbitrary or non-arbitrary disturbances and their frequency bands are situated essentially outside the Doppler frequency band, to which the proximity fuse has to be sensitive during normal operation. For the projectiles of the RDTC type, on the contrary, the additional disturbance induced by the emission of ionized gas at the base has two characteristics which render it very detrimental to a correct operation of the fuse: about half of the additional parasitic radio-electric energy is situated in the Doppler frequency band to be envisaged and the amplitude of these additional parasitic signals is comparable with that of the Doppler signals. With respect to such parasitic signals, the second anti-disturbance chain mentioned above is inoperative.

SUMMARY OF THE INVENTION

The invention has for its object to adapt the sensitivity of the module for processing the signal of the proximity fuse of an artillery projectile of the type having reduced aerodynamic resistance of the base.

Another object is to provide a proximity fuse which can be adapted to different types of artillery projectiles depending upon whether the latter are or are not of the RDTC type.

These objects are achieved by a proximity fuse as defined in the opening paragraph which further comprises a supplementary chain for suppressing the parasitic effect caused in the said first chain by the electromagnetic disturbances due to the reduction of the aerodynamic resistance of the base, this second chain having characteristics of band-pass filtering, amplification and exceeding of the threshold by the said beat signal comparable with those of the said first chain. The output signal of the supplementary chain is transmitted to inhibition means for inhibiting partially or entirely through the said first chain or through the said ignition circuit the ignition of the proximity fuse, and the said supplementary chain comprises first delaying means, which delay the appearance of the said output signal with respect to the input signal by a time $T_1$ exceeding the maximum value of $\tau_1$, and second delaying means for maintaining the said output signal of the supplementary chain during a time $T_2$ of the order of a few seconds after said amplified and filtered beat signal has stopped to exceed the threshold at the supplementary chain.

Since the supplementary chain processes signals whose amplitude and frequency are comparable with those of the useful signals, that is to say Doppler target signals, the delay $T_1$ permits of avoiding that the supplementary chain inhibits the first chain in the most frequently occurring case in which the shell arrives at the ground after the RDTC effect has stopped, which permits the first chain of igniting the explosion, as provided in the nominal manner. For short-range gun-fire, which remains interesting with projectiles of the RDTC type because of their increased speed, it can be ensured that the first chain is only partially inhibited, in which event the arrival at the ground can take place while the RDTC phase still exists.

It should be noted that it has become possible to establish the delay time $T_1$ due to the property that the RDTC disturbance signal exists from the departure of the projectile, that is to say during the initial phase in which any explosion of the projectile has become impossible due to safety measures for the artillery-man. Otherwise, the presence of the supplementary chain is compatible with that of the second chain according to the prior art described above.

According to a preferred embodiment of the invention, the said proximity fuse comprises the cascade arrangement of a first and a second timing circuit of the ignition circuit; the first chain comprises behind the said mixer the cascade arrangement of a pass-band filter, an amplifier, a threshold circuit and a pulse counter for a gradual continuous resetting to zero and the said igniter, and the supplementary chain comprises the cascade arrangement of a pass-band filter, an amplifier, the said first and second delaying means, a threshold circuit and a decision circuit supplying the said output signal.

An advantageous embodiment of the proximity fuse, in which the pulse counter of the first chain constituted by a charge transfer circuit between a first and a second capacitor is inhibited partially, is characterized in that the said output signal of the supplementary chain acts through the inhibition means upon the said first capacitor so that the charge transfer of the latter is reduced each time the threshold is exceeded in the threshold circuit of the first chain.

According to the latter embodiment, if the arrival of the projectile at its target, in this case the ground, takes place during the reduction of the air resistance of the base, the fuse still operates in the proximity at a height reduced with respect to the given nominal height.

BRIEF DESCRIPTION OF THE DRAWINGS

The invention will now be described more fully, by way of example, with reference to the accompanying drawings, in which.

Figure 3:
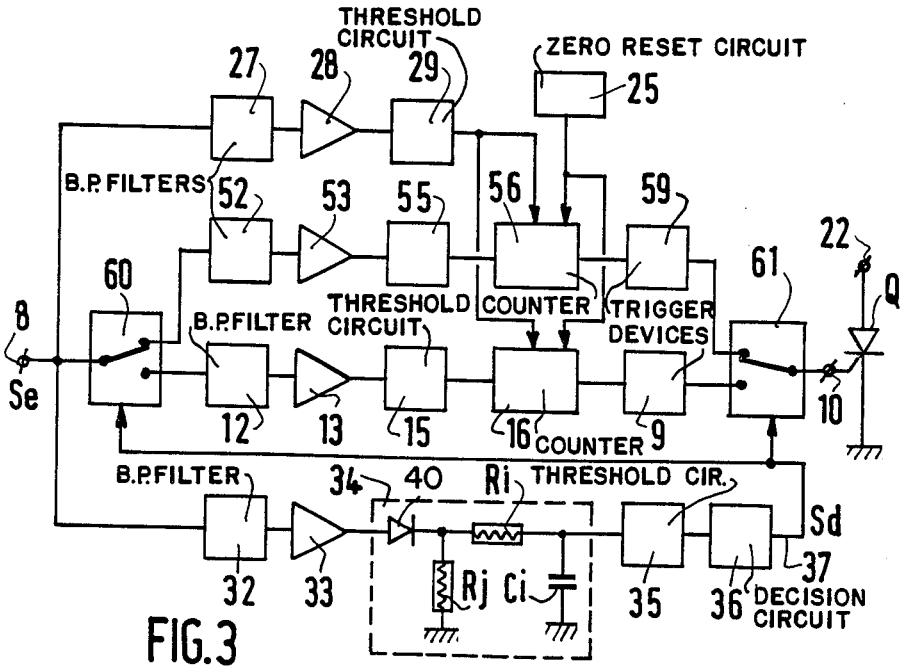
Figure 4:
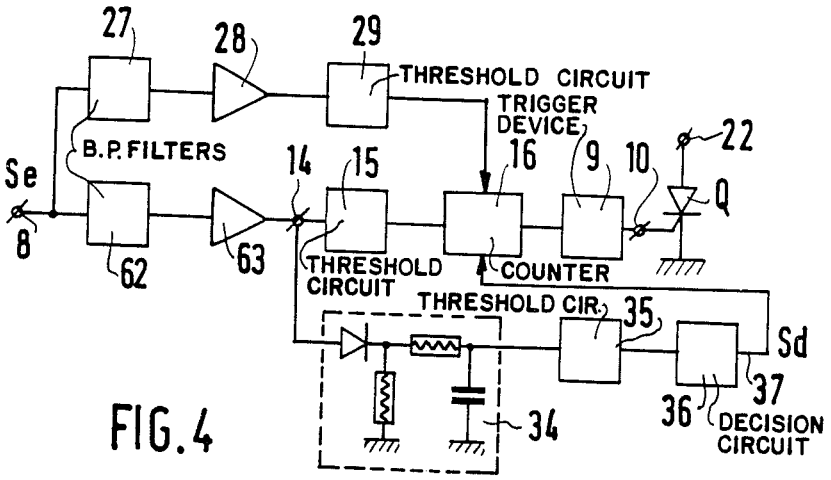
Figure 5:
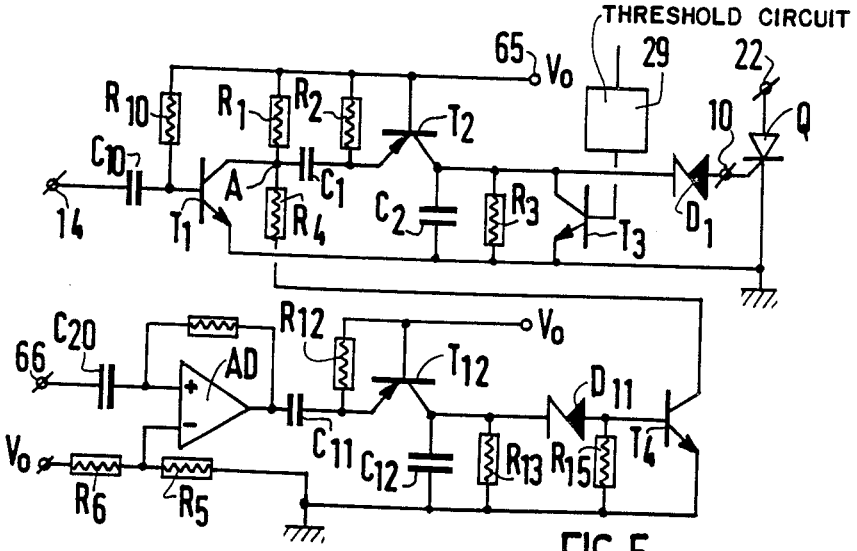

FIG. *2a* shows as a function of time the form of the beat signal to be processed and FIGS. *2b* to *2d* show time diagrams explaining the operation of the proximity fuse according to the invention;

FIG. 3 shows a partial electronic block circuit diagram of a first embodiment of the invention;

FIG. 4 shows a partial electronic block circuit diagram of a second embodiment of the invention;

FIG. 5 shows an electronic circuit diagram of a part of a first processing chain and of a part of the supplementary chain for a third embodiment of the invention.

In the Figures, the same reference symbols designate the same elements with the same functions.

DESCRIPTION OF THE PREFERRED EMBODIMENTS

The arrangement of the RDTC type projectile is a relatively recent development. The principle consists in that the back side of the shell projectile is provided with an appendix open on the back side and containing a combustible material; the combustible material is inflamed when the projectile leaves, which becomes manifest by the presence of inflamed gases in the track of the shell and by the increase of pressure, which leads to a reduction of the air resistance of the base that may reach a value of up to 80%. Although the projectile then operates as a fuse motor, the emission of inflamed gases takes place at a subsonic speed and no additional propulsion force is supplied which results in that the precision of the gun-fire is not at all affected by this arrangement. The RTDC phase is ensured to exist for the most rapid part of the trajectory of the shell, for which the efficiency of the arrangement is a maximum, i.e. for the 20 to 30 first seconds calculated from the beginning of the gun-fire denoted by $t_o$. For shots at a large emission angle in the proximity of 45° with respect to the horizontal, the RDTC phase is considerably shorter than the whole time of the trajectory of the shell; on the contrary, for shots at a small emission angle, the arrival at the ground can take place during the RDTC phase. The above explanations with respect to the operation of the projectiles of the RDTC type are useful for a clear understanding of the invention.

Figure 1:
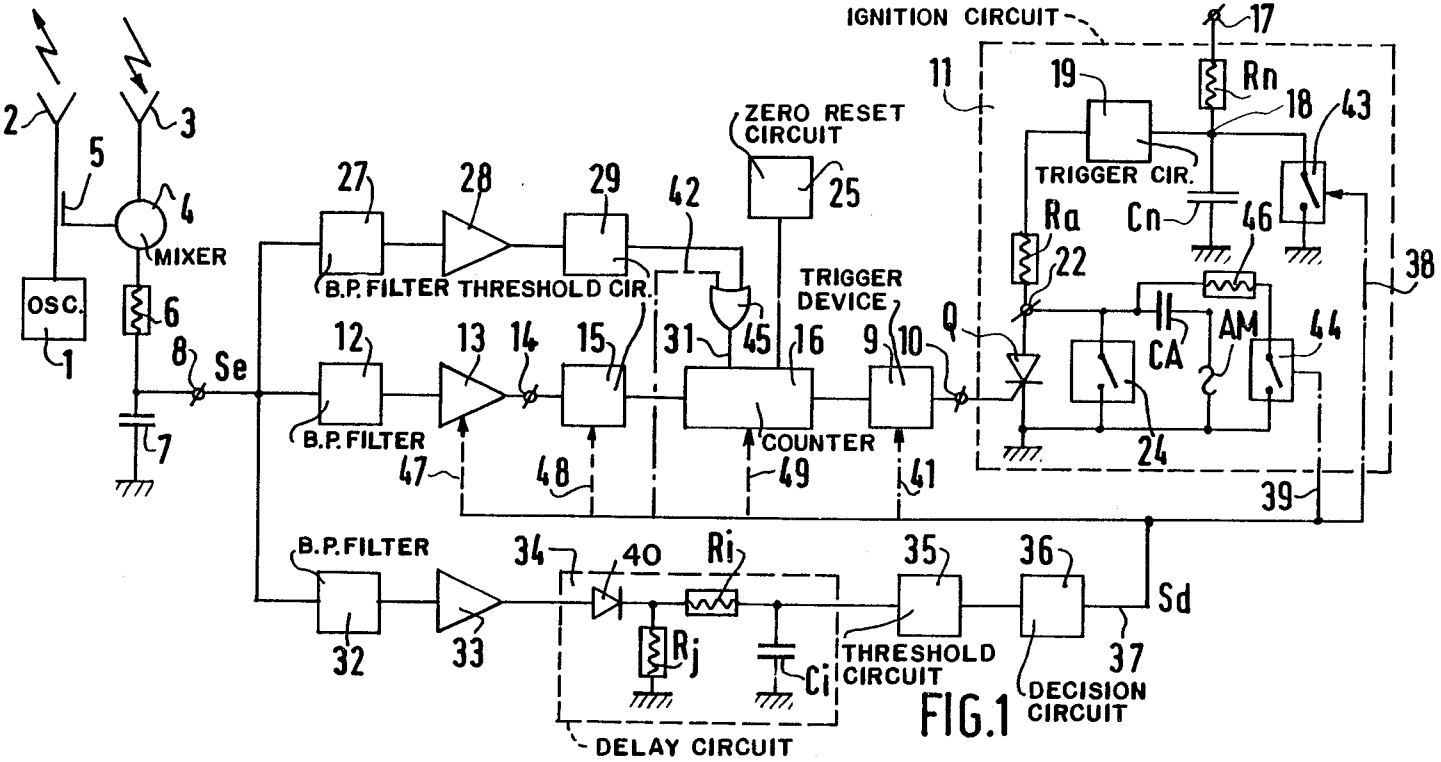
FIG. 1 shows an electronic block circuit diagram of the assembly of the proximity fuse according to the invention.

A known proximity fuse for an artillery projectile can comprise, as shown in FIG. 1, a radar arrangement constituted, for example, by an oscillator 1 coupled to a transmission antenna 2 for transmitting a continuous wave. The wave reflected by the target, normally the ground, is collected by a reception antenna 3, which is assumed, for example, to be distinct from the transmission antenna. The antennae 2 and 3 are assumed to be omnidirectional. A mixer circuit 4 forms the beat difference signal between the signal supplied by the reception antenna 3 and the signal supplied by the coupler 5, which derives a fraction of the signal originating from the oscillator 1. After suppression of the continuous component by means of a resistor 6 and a capacitor 7, this beat signal is supplied as a signal $S_e$ at a terminal 8. In known manner, the terminal 8 is connected to a first chain for processing the signal $S_e$ intended to activate the trigger device 9 of the ignition circuit 11 of the fuse at the end of a variable time $\tau_1$, as described in greater detail hereinafter. The first chain comprises in cascade arrangement between the terminal 8 and a terminal 10 a pass-band filter 12, an amplifier 13, a terminal 14, a threshold circuit 15, a pulse counter 16 and the trigger device 9. The filter 12 and the amplifier 13 are constituted, for example, by operational amplifiers. The filter 12 allows the passage of signals at frequencies typically lying between 50 Hz and 300 Hz, which in practice is the expected Doppler frequency range for the shell at its arrival at the ground in dependence upon its speed and upon its incidence angle for a given corresponding frequency of the transmitted wave. The threshold circuit 15 can be obtained by means of a transistor or of an operational amplifier. The pulse counter 16, whose main function is to establish the time $\tau_1$, is, for example, an analogue counter of the kind described in detail hereinafter with reference to FIG. 5. The trigger device 9 can be a Zener diode. The ignition circuit 11 shown within a broken line comprises between an electric supply terminal 17 and earth a first timing circuit constituted by the series-combination of a resistor Rn and of a capacitor Cn defining a charging time Tn=RnCn. The junction point 18 of the elements Rn and Cn is connected to a trigger circuit 19, for example a suitably polarized transistor, which in turn supplies a second timing circuit only when a predetermined voltage threshold is reached at the point 18. The second timing circuit is composed of the series-combination of a resistor Ra, of a branch point 22 and of a capacitor Ca connected to earth through the ignition element AM. Otherwise, the point 22 is connected to earth by the parallel-combination of the anode-cathode path of a thyristor Q, whose gate is connected to the terminal 10, and of an electromechanical target switch 24. The electric supply at the terminal 17 and at other points of the circuit is effected in known manner not shown, for example by means of a stack, of which the electrolyte is freed under the influence of the shock when the shell leaves. At the end of a time Tn of the order of 9 seconds fixed by the values of Rn and Cn, the capacitor Ca is in turn charged through the resistor Ra and the voltage at the point 22 increases to a value such that an abrupt discharge of the capacitor Ca at this voltage value through the single ignition element AM would be sufficient to ignite the latter with certainty, this voltage value being obtained at the end of a time Ta of the order of one second, which is added to the time Tn. Summarizing, the ignition of the ignition element AM can only be obtained after a time Tn+Ta of the order of 10 seconds after the shell has left, either by triggering of the thyristor Q through the first chain, or by closure of the switch 24 obtained by percussion against the ground.

The principle of the operation of the counter 16 in its analogue version is as follows: between two values exceeding the threshold in the form of pulses of the filtered and amplified signal $S_e$, in the threshold circuit 15, a first capacitor of low capacitance is charged by a constant voltage through a resistor during the time in which the pulse exceeds the threshold; the charge of the first capacitor is transferred to a second capacitor of high capacitance. Otherwise, the second capacitor is shunted by a resistor for resetting to zero, which provides a gradual continuous resetting to zero of the second capacitor. In FIG. 1, this gradual continuous resetting to zero is shown symbolically by a circuit 25 for automatically resetting to zero. For threshold exceeding pulses sufficiently close to each other in time, the discrete charging of the second capacitor predominates over its continuous discharge and the elements of the pulse counter 16 can be proportioned so that a second voltage threshold apt to render the thyristor Q conducting is obtained at the end of a predetermined number N of Doppler pulses whose amplitude exceeds a first threshold at 15, the Doppler pulses concerned in a number of, for example, N=5 being sufficiently close to each other so that the charge of the second capacitor distinctly predominates over its discharge. The time $\tau_1$ defined above can consequently be expressed in the form:

$$\tau_1 = N_\tau,$$

$\tau$ designating the period of the signal at the Doppler frequency for the considered shot. In practice, typically a difference in height of 1 meter over the final part of the trajectory of the projectile corresponds to the period $\tau$. Since the amplitude of the echo signal increases very considerably during the arrival at the ground, this becomes manifest by an envelope of a substantially hyperbolic form of the beat signal in the twenty or thirty last meters of the trajectory. The threshold circuit 15 is controlled, for example, so that the threshold is exceeded by the target signal from a height of 15 meters at the time $t_{10}$. According to what has been stated above, this results in that the ignition of the fuse will take place five meters lower, that is to say at the nominal height of 10 meters at the time $t_{11}$ ($\tau_1 = t_{11} - t_{10} \cong 0.1$ s).

Still according to the prior art, the proximity fuse shown in FIG. 1 can comprise a second anti-disturbance chain, which receives the signal present at the terminal 8. This second chain comprises, for example, a bandpass filter 27, an amplifier 28 and a threshold circuit 29. The output of the circuit 29 is connected to an input 31 of the pulse counter 16 to shunt in the latter the resistor for resetting to zero for producing an abrupt resetting to zero of the second capacitor, which leads to the inhibition of the triggering of the thyristor 10. The circuits 27, 28 and 29 may be of the same structure as the corresponding circuits 12, 13 and 15 of the first chain, but they are controlled by different means and the passband(s) of the filter 27 has (have) to be disjointed from the pass-band of the filter 12 in order to avoid the inhibition of the triggering of the thyristor Q upon the arrival at the ground of the projectile.

According to the invention, a supplementary chain, which receives in the same manner as the first and second chains the signal $S_e$ at the terminal 8, serves to suppress especially the radio-electric disturbance induced by the operation of the RDTC arrangement during the firing of the projectile. This supplementary chain comprises in cascade arrangement a bandpass filter 32, an amplifier 33, delay means 34 producing first and second delays, a threshold circuit 35 and a decision circuit 36, whose output 37 is provided for controlling one or several elements of the first chain or of the ignition circuit 11 of the fuse. The passband of the filter 32 encompasses that of the filter 12 and has substantially the same lower terminal as the latter. This pass-band is, for example, 50 to 1500 Hz, half of the energy being concentrated at the lowest frequencies, which are also the Doppler frequencies, i.e. between 50 and 350 Hz. The amplification factor of the amplifier 33 is comparable with that of the amplifier 13. The delaying means 34 produces a first delay $T_1$ upon the appearance and a second delay $T_2$ upon the disappearance of the RDTC signal, and is shown in FIG. 1 symbolically by a network comprising resistors and a capacitor. The durations $T_1$ may be of the order of 2 s and $T_2$ of the order of a few seconds, but must be fairly strongly variable depending upon the type of projectile and are controlled independently of each other. According to the assembly of FIG. 1, the time $T_1$ is established by the series arrangement from the output of the amplifier 33 of a diode 40 in forward direction, a resistor Ri and a capacitor Ci, of which a plate is connected to earth. To establish time $T_2$, a resistor $R_j$ is connected between the junction point of the diode 40 and the resistor Ri and earth in such a manner that the capacitor Ci is discharged through the series arrangement of the resistors Ri and Rj, this arrangement being insulated upstream by the diode 40. The exact function fulfilled by the introduction of the delays $T_1$ and $T_2$ is explained below with reference to FIG. 2. For example, the threshold circuit 35 is constituted by a Zener diode, whose inverse conduction voltage defines the desired voltage threshold, while the decision circuit 36 is constituted by a transistor which is connected in forward direction when this inverse voltage is exceeded so that essentially the output conductor 37 is connected to earth, in which situation the output signal $S_d$ at the conductor 37 in the so-called logic state "1" activates at least one element of the ignition circuit 11 of the fuse or at least one element of the first chain for inhibiting entirely or partially the ignition of the proximity fuse. The total inhibition is indicated in FIG. 1 by dot-and-dash lines 38, 39, 41, 42, which connect the conductor 37 to a voltage-controlled interruptor 43 or to a voltage-controlled interrupter 44 or to the trigger device 9 or further to the input 31 of the pulse counter 16, either directly or with the output of the second chain through a logic OR gate circuit 45, of which another input is connected to the output of the threshold circuit 29 when a second anti-disturbance processing chain is present. The voltage-controlled interruptor 43 is connected between the point 18 and earth. The state "1" of the signal $S_d$ can thus lead to the closure of the switch 43, which inhibits the operation of the first timing circuit by preventing the capacitor Cn from being charged. In an analogous manner, the voltage-controlled interruptor 44 is connected between earth and the terminal 22 with a high-value series resistor 46 in such a manner that the operation of the second timing circuit is inhibited by closure of the interruptor 44 when the signal $S_d$ is in the state "1". The line 41 symbolically indicates, for example, the fact that the terminal 10, i.e. the gate of the thyristor Q, is directly connected to earth in order to hold this thyristor in the non-conductive state, while the line 42 has on the counter circuit 16 the same predominant effect of resetting to zero as the second chain when the latter is present. In FIG. 1, the partial inhibition of the ignition of the proximity fuse is indicated by broken lines 47,48,49 which connect the conductor 37 to the amplifier 13, to the threshold circuit 15 or to the pulse counter 16.

When the signal $S_d$ is in the state "1", it is thus possible to reduce the amplification of the amplifier 13 or to raise the level of the threshold in the circuit 15 in known manner or further to modify the counter position in the pulse counter 16, as described below with reference to FIG. 5.

Figure 2:
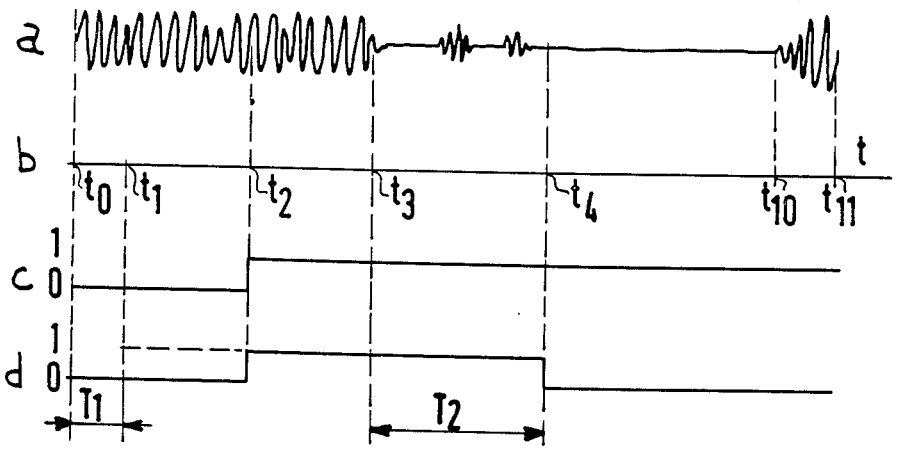

FIG. 2 shows at a the signal $S_e$ present at the terminal 8 of FIG. 1, for which in chronological order four phases are distinguished, which are indicated on the time axis of FIG. 2*b:* the main RDTC phase lying between instants $t_0$ and $t_3$ and lasting 20 to 40 seconds; the so-called re-ignition phase lying between $t_3$ and $t_4$, which is that during which the RDTC arrangement theoretically made inoperative by the disappearance of the combustible material may still operate sporadically; the phase lying between $t_4$ and $t_{10}$, during which the RDTC arrangement no longer operates and the target signal is not yet perceptible; subsequently the final phase between $t_{10}$ and $t_{11}$ already described above, during which the target signal is taken into account by the pulse counter 16.

FIG. 2*c* characterizes the operation of the proximity fuse in the so-called percussion emergency mode. Between the instants $t_0$ and $t_2$, $t_2$ preceding $t_3$, the two timing circuits of the ignition circuit 11 prevent any explosion, the capacitor $C_A$ not yet being charged sufficiently, which is indicated symbolically in FIG. 2*c* by a logic level "0". After the instant $t_2$, the percussion on the ground of the projectile leads to the explosion by triggering of the electromechanical target switch 24, which is indicated symbolically by the logic level "1".

FIG. 2*d* shows again the phase of total inhibition lying between $t_0$ and $t_2$ reinforced, if necessary, by the total or partial inhibition produced by the supplementary chain between the instants $t_1$ and $t_2$, the instant $t_1$ preceding $t_2$ being that for which the signal $S_d$ passes from the state "0" to the state "1" with: $t_1-t_0=T_1$. The phase lying between $t_2$ and $t_4$ is that during which the sigal $S_d$ is in the state "1", the inhibition due to the timing circuits being raised, which is indicated symbolically by the logic level "1", this phase terminating by the re-ignition phase from $t_3$ to $t_4$, whose duration $t_4-t_3$ is identified with the delay $T_2$ to the extent to which it is possible to estimate precisely the duration $t_4-t_3$ associated with the considered type of projectile. For safety reasons, the duration $T_2$ may be chosen so as to exceed the estimated duration $t_4-t_3$, which holds especially for projectiles whose firing angle is large. On the contrary, for projectiles whose re-ignition phase is short and/or for which the firing angles are small, it is advantageous to regulate the delay $T_2$ to a low value in order to increase the probability of the arrival at the ground of the projectile after the instant $t_4$, that is to say at an instant at which the supplementary chain no longer inhibits the operation of the first chain and at which the operation of the proximity fuse is nominal, which is indicated symbolically by a logic level "0" in FIG. 2*d*. The duration $T_2$ lies, for example, between 3 s and 10 s.

FIG. 3 shows a particular embodiment of the invention, in which besides the first chain a first auxiliary processing chain is used, which is constituted like the first chain, by the cascade arrangement of a bandpass filter 52, an amplifier 53, a threshold circuit 55, a pulse counter 56 and a trigger device 59. The first chain and the first auxiliary chain are connected to the terminals 8 and 10 through two-position switches 60 and 61 in such a manner that, when the signal $S_d$ at the conductor 37 is in the state "1", the first auxiliary chain is connected to the terminals 8 and 10, the first chain not being connected, as shown in the Figure, the position of the switches 60 and 61 being inverted when the signal $S_d$ is in the state "0". The first auxiliary chain can have a structure identical to that of the first chain, but its elements are controlled so as to be less sensitive to a Doppler frequency signal than those of the first chain. Especially the filter 52 may be more selective than its counter part 12 so as to improve the signal-to-noise ratio; the amplifier 53 can have a lower amplification than that of the amplifier 13; the threshold voltage can be higher at 55 than at 15 and the counter position can be higher at 56 than at 16. The switches 60 and 61 can be obtained simply by means of transistors. Otherwise, it will be appreciated that it is not indispensable to switch entirely from the first chain to a first complete auxiliary chain; only one element or a group of elements of the first chain may also be switched to corresponding elements, which are controlled by different means.

FIG. 4 shows how it is possible to use certain elements in common for the first processing chain and the supplementary chain. These elements are the band-pass filter 62 and the amplifier 63. It should be noted that, if the amplification of the amplifier 63 is not optimum either for the first processing chain or for the supplementary chain, it is always possible to compensate for this small defect by an adequate control of the elements situated downstream in one or the other of these two chains. In the embodiment shown in FIG. 4, the supplementary chain acts upon the first processing chain by modification of the counter position in the pulse counter 16, as will be explained in greater detail hereinafter with reference to FIG. 5.

FIG. 5 shows the part of the first processing chain and the part of the supplementary chain situated downstream of the filter 12 (32 and 62, respectively) and of the amplifier 13 (33 and 63, respectively). The terminal 14 is connected to the base of an NPN transistor $T_1$ through a capacitor $C_{10}$, which serves to suppress the d.c. component of the voltage signal at the terminal 14. The base of the transistor $T_1$ is connected to the supply terminal 65 at the positive voltage $V_0$ equal, for example, to 30 V through a polarization resistor $R_{10}$ having a variable value. The emitter of $T_1$ is connected to earth and its collector has a point A itself connected on the one hand to the supply terminal 65 through a resistor $R_1$ and on the other hand to a capacitor $C_1$, whose other plate is connected to the terminal 65 through a resistor $R_2$ and to the emitter of a PNP transistor $T_2$, whose band is connected to the terminal 65. The collector of $T_2$ is connected on the one hand to earth through the parallel-combination of a capacitor $C_2$, of a resistor $R_3$ and of the collector-emitter path of an NPN transistor $T_3$ and on the other hand to the cathode of a Zener diode $D_1$. Otherwise, the point A is connected through a resistor $R_4$ to the collector-emitter path of a transistor $T_4$ which is assumed to be cut off during a first time. The assembly essentially constituted by the elements $T_1$, $R_1$, $C_1$, $R_2$, $T_2$, $C_2$ is a charge transfer circuit known under the designation of transistor and diode pump with the difference that in the present assembly the diode is replaced by the resistor $R_2$. As long as a predetermined negative voltage threshold at the terminal 14 is not exceeded, the transistor $T_1$ is conducting and the capacitor $C_1$ is charged at the voltage $V_0$ through the resistor $R_2$, the charge of the capacitor $C_2$ being zero, while the transistor $T_2$ is cut off. When the threshold is exceeded for the first time and for the whole duration of the electric angle of the excess pulse beyond the threshold, the transistor $T_1$ is cut off, a voltage shift equal to $V_0$ is produced at the two plates of $C_1$, $T_2$ becomes conducting at the charge of $C_1$ is transferred to $C_2$ in such a manner that the voltage at the plate of $C_2$ is connected to the collector of $T_2$ passes from the value zero to the value:

$$\frac{C_1 V_0}{C_2},$$

$C_1$ and $C_2$ also designating the capacitances of the capacitors $C_1$ and $C_2$, respectively, and being in a ratio of the order of 1 to 10. Between two successive threshold excess pulses, $C_1$ is charged again and $C_2$ is discharged through $R_3$, which forms the gradual continuous resetting to zero of the pulse counter 16. The operating cycle described above is repeated for each threshold excess pulse and the charge states of $C_2$ for sufficiently adjacent pulses, such as those due to the target signal, are substantially equal to:

$$\frac{C_1 V_0}{C_2}, \frac{2C_1 V_0}{C_2}, \frac{3C_1 V_0}{C_2}, \ldots$$

whilst neglecting the leakage current of $C_2$ through $R_3$. The presence of the resistor $R_2$ at the area of a diode permits of obtaining increases in charge of $C_2$ substantially equal to each pulse instead of an exponentially increasing variation in such a manner that after a predetermined number N of charge increases, i.e. of threshold excess pulses at 14, the inverse conduction voltage of the diode $D_1$ is exceeded, which has the effect of rendering the thyristor Q conducting. This number N is chosen, for example, to be equal to 5. It is possible to cause the value of N to vary slightly by modifying slightly one or several of the following parameters: value of $C_1$, $C_2$, $R_2$, $R_3$ and inverse voltage of $D_1$. The output signal of the threshold circuit 29 of the second processing chain is supplied to the base of $T_3$ in order to render this transistor conducting and thus to produce the quasi instantaneous discharge of the capacitor $C_2$. In the presence of parasitic signals, for which the threshold exceedings are irregular and on an average are spaced apart by a distinctly longer time than those due to the target signal, the discharge of $C_2$ through $R_3$ is predominant over the charge and the inverse voltage threshold of $D_1$ in general cannot be attained. For parasitic signals of the RDTC type, on the contrary, the frequency of the threshold excess pulses at 14 can be sufficient in order that, the charge of $C_2$ predominantly over its discharge, the inverse voltage of $D_1$ is attained at the end of an undetermined number of threshold exceedings at 14, which would lead to a premature ignition of the proximity fuse. In order to avoid this disadvantage, it is ensured that such a parasitic RDTC signal produces the increase of the counter position N. For this purpose, the supplementary chain comprises downstream of the amplifier 33 or 63 from a terminal 66 a circuit comparable with that described above for the first chain, i.e. a capacitor $C_{20}$ for suppressing the direct voltage component, a differential amplifier AD fulfilling a function analogous to that of the transistor $T_1$, of which the inverting input constituting a threshold is suitably polarized by means of resistors $R_5$ and $R_6$, capacitors $C_{11}$ and $C_{12}$, resistors $R_{12}$ and $R_{13}$, a transistor $T_{12}$ and a Zener diode $D_{11}$, which are counterparts of the components $C_1$, $C_2$, $R_2$, $R_3$, $T_2$ and $D_1$, respectively.

However, the function fulfilled by the latter circuit is different and, properly speaking, does not consist of a counter position, but consists in establishing a signal beyond a given threshold having a delay $T_1$ upon appearance and a delay $T_2$ upon disappearance. The delay $T_1$ is obtained by means of the transistor pump $T_{12}$ and the resistor $R_{12}$ by the trnsfer of charge between $C_{11}$ and $C_{12}$; the threshold function is fulfilled by the Zener diode $D_{11}$, whose anode is connected to the base of the transistor $T_4$ and to earth through a resistor $R_{15}$. The discharge of $C_{12}$ through $D_{11}$ and $R_{15}$ defines the delay $T_2$. The latter circuit is controlled so that the RDTC signal causes the transistor $T_4$ to be rendered conducting, which has the effect that the voltage at the point A is reduced in the cut-off state of the transistor $T_1$ from the value $V_0$ to the value $$\frac{R_4}{R_1 + R_4} V_0,$$

for example the value $V_0/2 = 15$ V if the values of $R_1$ and $R_4$ are equal. This results in that upon each transfer of charge from $C_1$ to $C_2$ the transmitted quantity electricity is lower, for example, in a ratio of 1 to 0.5 as compared with the operation described above. For the target signal, this becomes manifest by a doubled value N. Physically, this means for an arrival at the ground of the projectile in the RDTC phase that instead of a Doppler pulse counter position between 15 m and 10 m above the ground with explosion at the nominal height of 10 m of the projectile, a Doppler pulse counter position is then obtained between 15 m and 5 m with explosion at the reduced height of 5 m on the basis of a Doppler periode per beveled meter. It should be noted that according to this hypothesis of the simultaneous presence of a target signal and of a parasitic RDTC signal, parasitic threshold excess pulses can slide between threshold excess pulses due to the target signal, which reduces correspondingly the ignition time of the fuse, counted from the instant $t_{10}$ marking the first counted pulse due to the target, and consequently approaching correspondingly the operation comprising an action of the supplementary chain, of the nominal operation of the first chain alone. For example, for 3 interdigitated parasitic pulses among 7 target pulses, which all three would be taken into account, the explosion in the proximity during the RDTC phase would take place at: $15-7=8$ m above the ground and it can be ensured that such a frequency of the parasitic pulses is insufficient to produce in themselves the explosion by sufficiently increasing the value of the resistor $R_3$.

The values of certain components of FIG. 5 are, for example, as follows:

| | | | |
|---|---|---|---|
| $R_{10}$: | 750k Ω | $C_{11}$: | 47 nF |
| $R_1$ and $R_4$: | 7.5k Ω | $C_{12}$: | 10 μF |
| $C_1$: | 4.7 nF | $R_{13}$: | 1 MΩ |
| $R_2$: | 100k Ω | $D_{11}$: | −15 V |
| $C_2$: | 47 nF | | |
| $R_3$: | 5 MΩ | | |
| $D_1$: | −15 V | | |

It should be noted that the ratio $C_{12}/C_{11}$ of the order of 200 is considerably higher than the ratio $C_2/C_1$ of the order of 10. This corresponds to the fact that two hundred RDTC pulses are necessary for estalishing the delay $T_1$ of the order of 2 s, while the time $\tau_1$ of the counter position of five to ten threshold excess pulses at 14 is obtained in about 0.1 s.

It should be noted that the differential amplifier AD is not indispensable and that the terminsl 66 could be directly connected to the capacitor $C_{11}$, with small modifications of the part of the circuit situated downstream to compensate for the fact that the charging of $C_{11}$ no longer takes place at a constant voltage. It is also possible to replace the resistor $R_{12}$ by a diode. Otherwise, the differential amplifier AD could be replaced by a transistor and the transistor $T_1$ could be replaced by a differential amplifier.

The invention is not limited to an analogue embodiment, for the different chains may also carry out a digital processing of the signal $S_e$ especially for the counter position N and the establishing of the delay times $T_1$ and $T_2$.

What is claimed is:

1. An improved proximity fuse for an artillery projectile of the kind which emits inflamed gases during launch to achieve reduced aerodynamic resistance at the base of the projectile, such inflamed gases radiating interfering electromagnetic waves, such fuse comprising:

an ignition circuit actuated by a trigger device for igniting the projectile upon reaching proximity to a target;

a radar circuit which transmits Doppler radar waves and receives corresponding Doppler echo waves, such radar circuit comprising a mixer which produces from the transmitted and received waves beat signals $S_e$ within a predetermined Doppler frequency band, said mixer also producing parasitic signals within such Doppler frequency band in response to the interfering electromagnetic waves radiated during launch of said projectile; and a first signal processing circuit chain connected to the output of said mixer for comparing the amplitudes of the beat signals produced thereby with a reference threshold level, and which is further connected to said trigger device for actuating it a predetermined time interval $\tau_1$ after a predetermined number N of such beat signals have exceeded such threshold level, such first signal processing circuit chain having a band-pass characteristic covering said Doppler frequency band;

such improvements being characterized in that said proximity fuse further comprises a supplementary signal processing circuit chain connected to the output of said mixer and having a band-pass characteristic corresponding to said Doppler frequency band, such supplementary signal processing circuit chain producing output signals in response to signals from said mixer which are within said Doppler frequency band and which exceed a second predetermined threshold level, said supplementary signal processing circuit chain comprising:

first delay means for delaying each of such output signals for a first time interval $T_1$ following the corresponding signal from said mixer, such interval $T_1$ being less than said predetermined time interval $\tau_1$; and second delay means for maintaining each of such output signals for a second time interval $T_2$ following termination of the corresponding signal from said mixer; and means connected to said trigger device for inhibiting actuation thereof by said first signal processing circuit chain during the time from the end of said interval $T_1$ to the end of said interval $T_2$.

2. An improved proximity fuse in accordance with claim 1, wherein said first signal processing circuit chain comprises a counter which counts the number of beat signals $S_e$ which exceed said reference threshold level and which actuates said trigger device after counting said predetermined number N of such beat signals, and the output signals from the supplementary signal processing circuit chain cause said inhibiting means to inhibit actuation of said trigger device by inhibiting the count of said counter.

3. An improved proximity fuse in accordance with claim 1, wherein said first signal processing circuit chain and said supplementary signal processing circuit chain each comprise a band pass filter and an amplifier connected in cascade, such filters having identical passbands and such amplifiers having the same gain factors.

4. An improved proximity fuse in accordance with claim 2, wherein said counter is constituted by a circuit which transfers charge from a first capacitor to a second capacitor therein and the output signals from the supplementary signal processing chain cause said inhibiting means to inhibit the count of said counter by reducing charge transfer from said first capacitor to said second capacitor.

5. An improved proximity fuse in accordance with claim 1, further comprising an auxiliary signal processing circuit chain connected to the output of said mixer, the output of said auxiliary circuit chain being connected to said inhibiting means in said supplementary circuit chain, said auxiliary circit chain being responsive to beat signals $S_e$ which exceed a higher threshold level than said reference threshold level of said first circuit chain to cause said inhibiting means to switch said trigger device from the output of said first circuit chain to the output of said auxiliary circuit chain when a beat signal Se exceeds such higher threshold level.

* * * * *